US010711553B2

(12) United States Patent
Kochanek et al.

(10) Patent No.: US 10,711,553 B2
(45) Date of Patent: Jul. 14, 2020

(54) DESTRUCTIBLE CASING SEGMENTATION DEVICE AND METHOD FOR USE

(71) Applicant: Ensign-Bickford Aerospace & Defense Company, Simsbury, CT (US)

(72) Inventors: Andrew M. Kochanek, Suffield, CT (US); Kurt Nelson, West Simsbury, CT (US); Jared Holtman, Agawam, MA (US); Scott Gammons, Higganum, CT (US); James Danyluk, Windsor Locks, CT (US); Alan Garvey, Suffield, CT (US); Marc Morris, Clarksville, TN (US); Joseph Smith, Burlington, CT (US)

(73) Assignee: Ensign-Bickford Aerospace & Defense Company, Simsbury, CT (US)

( * ) Notice: Subject to any disclaimer, the term of this patent is extended or adjusted under 35 U.S.C. 154(b) by 99 days.

(21) Appl. No.: 16/060,495

(22) PCT Filed: Dec. 8, 2016

(86) PCT No.: PCT/US2016/065557

§ 371 (c)(1),
(2) Date: Jun. 8, 2018

(87) PCT Pub. No.: WO2017/100417

PCT Pub. Date: Jun. 15, 2017

(65) Prior Publication Data

US 2019/0032435 A1 Jan. 31, 2019

Related U.S. Application Data

(60) Provisional application No. 62/264,708, filed on Dec. 8, 2015.

(51) Int. Cl.
*E21B 29/02* (2006.01)
*E21B 43/26* (2006.01)
(Continued)

(52) U.S. Cl.
CPC ..... *E21B 29/02* (2013.01); *E21B 33/12* (2013.01); *E21B 43/14* (2013.01); *E21B 43/26* (2013.01); *E21B 47/00* (2013.01)

(58) Field of Classification Search
CPC ..... E21B 29/02; E21B 33/12; E21B 43/14; E21B 43/26; E21B 47/00
See application file for complete search history.

(56) References Cited

U.S. PATENT DOCUMENTS 2,968,243 A 1/1961 Turechek et al.
3,659,652 A * 5/1972 Roberts ..... C09K 8/80 166/299

(Continued)

*Primary Examiner* — Yong-Suk Ro
(74) *Attorney, Agent, or Firm* — Getz Balich LLC

(57) ABSTRACT

A casing segmentation device and system, and a method for selectively providing a fluid flow passage through a casing segmentation device disposed within a well casing segment is provided. The casing segmentation device includes a body and a fracture mechanism. The body has a forward end, an aft end, a plug seat, and an internal passage. The plug seat is configured to receive a mating plug. The internal passage extends between the forward end and the aft end and through the plug seat. The fracture mechanism includes an amount of energetic material and a trigger mechanism. The trigger mechanism is configured to selectively cause a detonation of the amount of energetic material.

16 Claims, 4 Drawing Sheets

(51) Int. Cl.

| | |
|---|---|
| ***E21B 43/14*** | (2006.01) |
| ***E21B 33/12*** | (2006.01) |
| ***E21B 47/00*** | (2012.01) |

(56) References Cited

U.S. PATENT DOCUMENTS

| | | | | |
|---|---|---|---|---|
| 4,678,037 | A | 7/1987 | Smith | |
| 5,466,537 | A | 11/1995 | Diede et al. | |
| 7,377,690 | B1 | 5/2008 | Diede | |
| 2010/0051265 | A1 | 3/2010 | Hurst et al. | |
| 2012/0125631 | A1* | 5/2012 | Entchev ..... | E21B 33/12 166/376 |
| 2012/0181032 | A1* | 7/2012 | Naedler ..... | E21B 43/26 166/308.1 |
| 2013/0192829 | A1 | 8/2013 | Fadul et al. | |
| 2015/0275616 | A1 | 10/2015 | Epstein | |
| 2016/0130906 | A1 | 5/2016 | Garvey et al. | |

* cited by examiner

DESTRUCTIBLE CASING SEGMENTATION DEVICE AND METHOD FOR USE

This application is a PCT national stage application of PCT Patent Application No. PCT/US16/65557 filed Dec. 8, 2016, which claims priority to U.S. Patent Appln. No. 62/264,708 filed Dec. 8, 2015, which applications are hereby incorporated by reference.

BACKGROUND OF THE INVENTION

1. Technical Field

The present disclosure relates to subterranean well casing segmentation devices in general, and to well casing segmentation devices with removable components in particular.

2. Background Information

Subterranean wells can be used to locate and extract subterranean disposed raw materials. For example, wells may be used to locate and extract hydrocarbon materials (e.g., hydrocarbon fluids such as oil, and gases such as natural gas) from subterranean deposits. A water well may be used for locating and extracting potable or non-potable water from an underground water table. A well configured and located to locate and extract hydrocarbon materials typically includes a tubular casing disposed subsurface within the well, and pumping system for injecting materials into and for extracting materials out of the well. The casing may be oriented to have vertically disposed sections, horizontally disposed sections, and sections having a combined vertical and horizontal orientation.

The term "hydraulic fracturing" refers to well formation techniques (sometimes referred to as "well completion" techniques) that create fractures within the subterranean ground to facilitate extraction of hydrocarbon materials disposed within the subterranean ground. There are several hydraulic fracturing techniques currently used, including techniques that utilize fluid flow segmentation devices.

For example, "plug and perforation" techniques may utilize one or more plugs (a type of casing segmentation device) that are positionable within the well casing. The plugs are used to fluidically isolate (i.e., segment) casing sections for a variety of reasons; e.g., to permit specific casing sections to be radially perforated, etc. The perforations in the casing provide fluid paths for materials to selectively exit and enter a fluid passage within the casing. In some instances, the plugs are designed to include a fluid flow passage that permits fluid flow through the plug; i.e., between a forward end of the plug and an aft end of the plug. The passage has a ball seat disposed at or near the forward end of the passage. The term "forward end" refers to the end of the plug fluid flow passage disposed closest to the well head when disposed within the casing, and the term "aft end" refers to the end of the plug fluid flow passage disposed farthest from the well head when disposed within the casing. The passage ball seat is configured to receive a ball (sometimes referred to as a "frac-ball"). To segment the well casing, a frac-ball is introduced into the casing and the frac-ball is carried with fluid flow until it reaches the ball seat. Once the frac-ball is seated properly within the seat, the frac-ball closes the plug fluid passage and prevents fluid passage through the plug. The fluid on one side of the plug may then be increased dramatically in pressure; e.g., to perform the perforation/fracturing process. Another hydraulic fracturing technique utilizes a sliding sleeve type device (another type of casing segmentation device). In this approach, the casing typically includes multiple stages (e.g., each with a sliding sleeve assembly and a packer assembly) that are built into the casing. Each sliding sleeve assembly includes an inner component and an outer component, and the inner component may be biased to reside in a forward located closed position. The inner component includes a fluid flow passage that permits fluid flow through the sliding sleeve; e.g., between a forward end of the inner component and an aft end of the inner component. The passage has a ball seat disposed at the forward end of the passage. When a frac-ball is properly seated within the seat and sufficient pressure is created on the ball side of the sliding sleeve, the inner component will travel axially aftward relative to the outer component. The axial travel allows pressurized fluid to perforate the casing and create the fractured subterranean structure. The frac-balls used to activate the sliding sleeves (and the associated ball seats) may be arranged in a particular order for use in the casing; i.e., the smallest diameter frac-ball is introduced into the casing first and passes through the sliding sleeves having progressively smaller diameter ball seats until it reaches a ball seat that it cannot pass through and is consequently seated, thereby closing the fluid passage through the sliding sleeve. Each progressively larger frac-ball is introduced and the process is repeated until all the zones are fractured.

Once all of the zones are fractured, it is necessary to remove the frac-balls to permit fluid travel within the casing. It is known in the prior art to machine out a frac-ball and ball seat, but such a process is time-consuming and expensive. It is also known in the prior art to use a frac-ball made of a material that dissolves or erodes over time within the well fluid environment. These methods are not desirable because the dissolving or eroding process takes a considerable amount of time. In fact, the rate of dissolution or erosion can vary significantly depending on environmental conditions within the well, and consequently it may be unclear whether a frac-ball is removed or not at a given point in time. These type frac-balls also do not remove the ball seat. As a result, the balls seat can act as a flow impediment.

SUMMARY OF THE DISCLOSURE

According to an aspect of the present invention, a casing segmentation device is provided that includes a body and a fracture mechanism. The body has a forward end, an aft end, a plug seat, and an internal passage. The plug seat is configured to receive a mating plug. The plug seat is disposed between the forward end and the aft end. The internal passage extends between the forward end and the aft end and through the plug seat. The fracture mechanism includes an amount of energetic material and a trigger mechanism. The trigger mechanism is configured to selectively cause a detonation of the amount of energetic material.

According to another aspect of the present invention, a well casing segmentation system is provided that includes a frac-ball, a casing segmentation device, and a first fracture mechanism. The casing segmentation device has a body with a forward end, an aft end, a ball seat, and an internal passage. The ball seat is configured to receive the frac-ball. The ball seat is disposed between the forward end and the aft end. The internal passage extends between the forward end and the aft end and through the ball seat. The ball seat and the frac-ball are configured to mate with one another. The first fracture mechanism includes a first amount of energetic material and a first trigger mechanism configured to selectively cause a detonation of the first amount of energetic material. The first fracture mechanism is provided with one of the frac-ball or the casing segmentation device.

According to another aspect of the present disclosure, a method for selectively providing a fluid flow passage through a casing segmentation device disposed within a well casing segment is provided. The method includes: a) providing a frac-ball; b) providing a casing segmentation device having a body with a forward end, an aft end, a ball seat, and an internal passage, wherein the ball seat is configured to receive the frac-ball, and which ball seat is disposed between the forward end and the aft end, and wherein the internal passage extends between the forward end and the aft end and through the ball seat, wherein the ball seat and the frac-ball are configured to mate with one another and thereby prevent fluid flow through the casing segmentation device when the frac-ball is seated within the ball seat; c) providing a first fracture mechanism that includes a first amount of energetic material and a first trigger mechanism configured to selectively initiate the first amount of energetic material with one of the frac-ball or the casing segmentation device; and d) communicating with the first trigger mechanism to selectively detonate the first amount of energetic material, wherein the detonation of the first amount of energetic material causes at least one of the frac-ball or at least a portion of the casing segmentation device to break into discrete pieces, thereby providing the fluid flow passage through the casing segmentation device. The present disclosure is not limited to any particular order of steps within the method.

The foregoing features and the operation of the invention will become more apparent in light of the following description and the accompanying drawings.

DETAILED DESCRIPTION OF THE INVENTION

Figure 1:
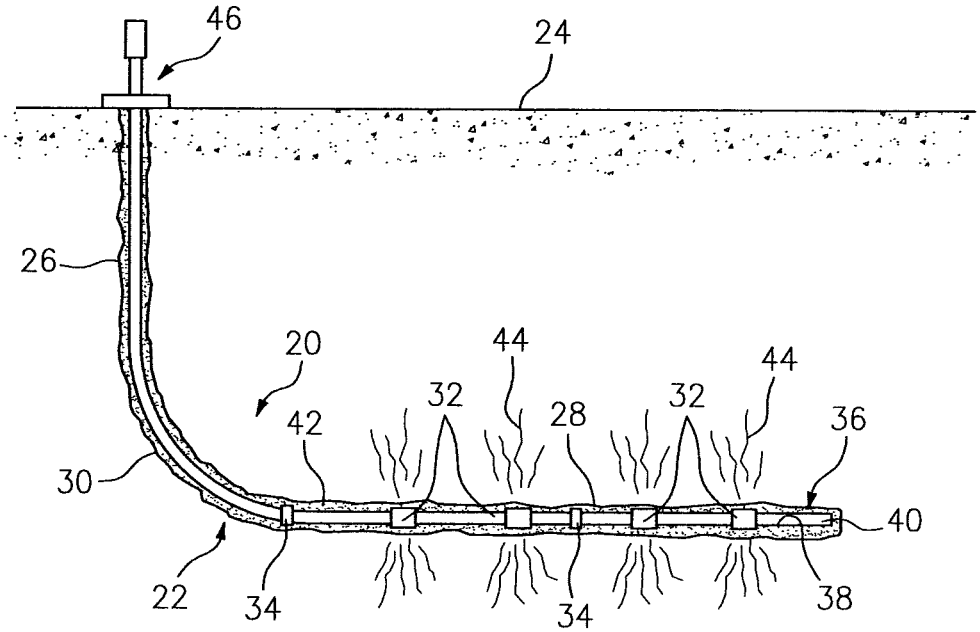
FIG. 1 is a sectional diagrammatic illustration of a portion of a well casing.
Figure 4:
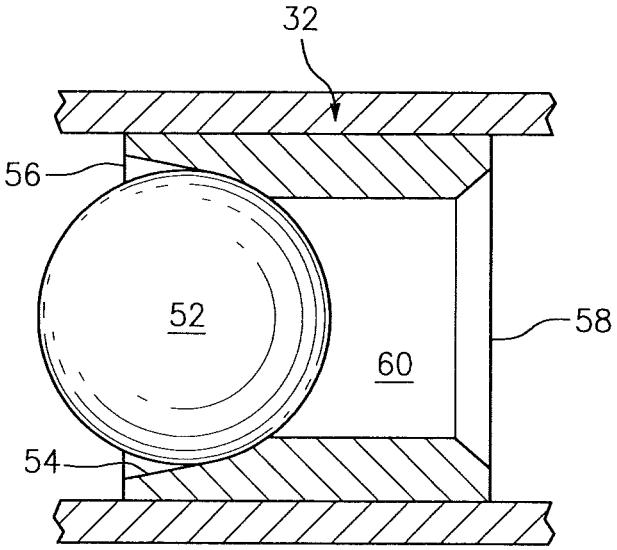
FIG. 4 (PRIOR ART)
FIG. 4 is a diagrammatic illustration of a prior art casing segmentation device.

Now referring to FIG. 1, an exemplary embodiment of a wellbore 20 disposed in a subterranean formation is shown. The wellbore 20 includes a fluid conduit (typically referred to as a "casing"; e.g., casing 22) disposed within a drilled bore extending below surface level 24. The wellbore 20 is diagrammatically shown as having a substantially vertical oriented section 26, a substantially horizontal oriented section 28, and an arcuate section 30 connecting the vertical and horizontal sections 26, 28. For purposes of describing aspects of the present disclosure, the casing 22 is described herein as including casing segmentation devices 32, packers 34, and pipe sections 36. The pipe sections 36 include a wall 38 surrounding a flow passage 40. The described well casing configuration reflects a typical configuration and the present disclosure is not limited to any particular well casing configuration. The casing 22 is disposed within the well after the well is drilled. The wellbore 20 is shown as having cement 42 disposed between the outer diameter of the casing 22 and the inner diameter of the drilled bore, which cement 42 secures the casing 22 within the drilled bore. Not all wellbores include cement or other material disposed outside of the casing 22.

Figure 2:
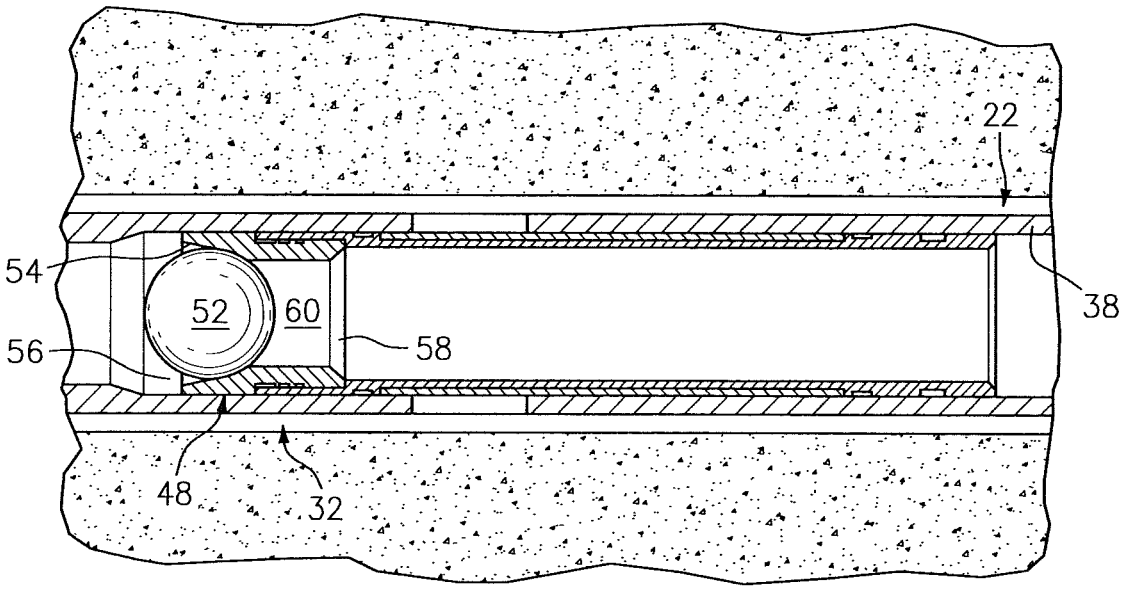
FIG. 2 (PRIOR ART)
FIG. 2 is a diagrammatic illustration of a prior art sliding sleeve type casing segmentation device shown in a closed configuration.
Figure 3:
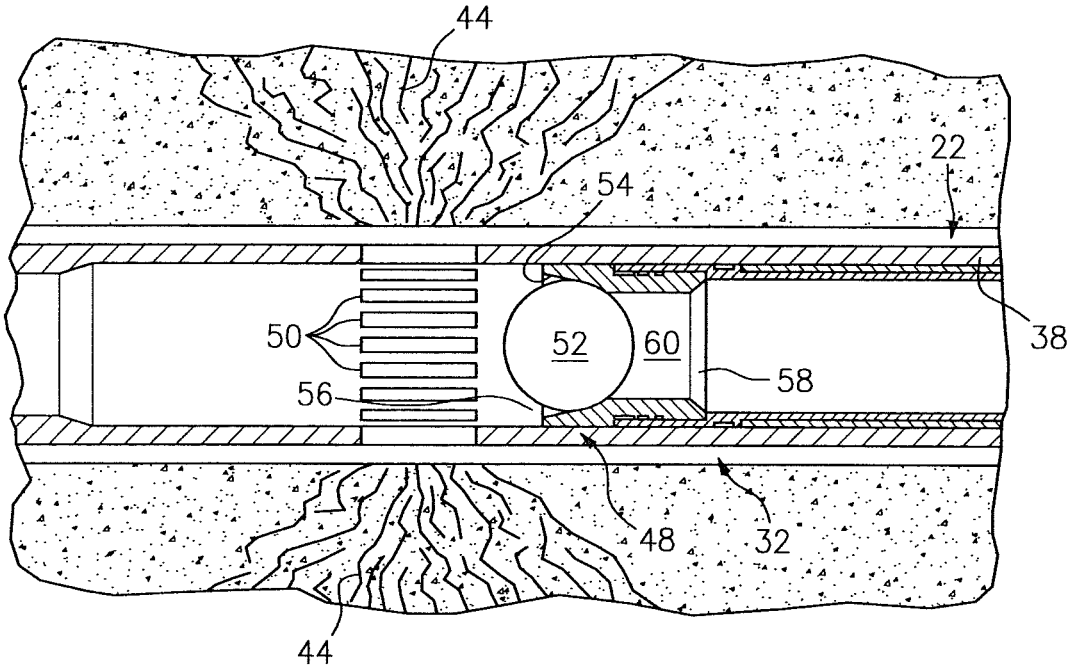
FIG. 3 (PRIOR ART)
FIG. 3 is a diagrammatic illustration of a prior art sliding sleeve type casing segmentation device shown in an open configuration.

As indicated above, a well completion process that utilizes hydraulic fracturing involves creating fractures 44 (e.g., cavities) within the subterranean ground adjacent the casing 22 to facilitate extraction of hydrocarbon materials (or water) disposed within the subterranean ground. The fracturing process is typically performed in segments (sometimes referred to as "stages"); e.g., a first segment of the casing 22 may be created adjacent the portion of the wellbore 20 furthest from the wellhead 46, and the casing 22 in that segment "perforated" to create a fluid path between the casing flow passage 40 and the subterranean environment adjacent the segment. Once the first segment is fractured, that segment may be isolated, and the process may be repeated for the next segment in line, until the all of the desired segments of the wellbore 20 are fractured. The term "perforated", as used herein, refers to the creation of the aforesaid fluid paths between the casing flow passage 40 and the subterranean environment adjacent the segment. In some instances, a pipe section 36 of the casing 22 is perforated by creating holes in the wall 38 of the pipe section 36 (e.g., using a perforating gun). In other instances, a casing section may be "perforated" by manipulating a sliding sleeve 48 (e.g., see FIGS. 2 and 3) or other valve-type casing segmentation device 32 into an open configuration, wherein apertures 50 in the sliding sleeve 48 are exposed to create the fluid paths between the casing flow passage and the subterranean environment adjacent the segment. FIG. 2 diagrammatically illustrates a sliding sleeve type casing segmentation device 32 disposed in a closed configuration; e.g., preventing fluid flow radially through the casing. FIG. 3 illustrates a sliding sleeve type casing segmentation device 32 disposed in an open configuration; e.g., allowing radial fluid flow through the casing via apertures 50. The present disclosure is not limited to use with any particular device or method for creating the fractures within the subterranean environment.

Aspects of the present disclosure include frac-balls 52, destructible casing segmentation devices 32, and methods for completing a well using these elements. As is described below, the present casing segmentation device 32 may be used with destructible frac-balls 52 or other types of frac-balls. To illustrate the utility of the present disclosure, the present disclosure is described herein in the context of a well formed to extract hydrocarbon based materials. The present disclosure is not limited to such applications.

Referring to FIGS. 4-7, the casing segmentation devices 32 (e.g., sliding sleeves, plugs, etc.) are designed to be positionally located within the casing 22; e.g., included at various predetermined positions within, or as part of, the casing 22 that is disposed within the wellbore 20. Each casing segmentation device 32 has a body 33 having a forward end 56, an aft end 58, a seat for receiving a mating plug (which seat is referred to hereinafter as a "ball seat 54"), and an internal fluid passage 60. The ball seat 54 is disposed at a position between the forward end 56 and the aft end 58. The internal fluid passage 60 extends between the forward end 56 and the aft end 58, and through the ball seat 54 between the two ends. The internal fluid passage 60, therefore, extends through the entirety of the casing segmentation device 32. The ball seat 54 is configured to prevent passage of a frac-ball 52 (i.e., a "mating frac-ball") of a predetermined size through casing segmentation device 32. For example in the absence of a mating frac-ball 52, the casing segmentation device 32 would allow a fluid flow to pass through the internal fluid passage 60; e.g., fluid entering the forward end 56 will pass through the internal fluid passage 60 and exit the aft end 58. When a mating frac-ball 52 is added to the fluid flow, the flow carries the mating frac-ball 52 into the casing segmentation device 32, wherein the mating frac-ball 52 engages the ball seat 54 and is prevented from traveling further through the casing segmentation device 32. The mating frac-ball 52 now disposed within the ball seat 54 prevents (or substantially prevents) fluid flow from passing through the casing segmentation device 32. The terms "mating" or "mates as used herein refer to the frac-ball 52 and the ball seat 54 having complementary geometries as is described below.

According to the present disclosure, the ball seat 54 is not limited to any particular geometry, other than having a geometry that mates with the frac-ball 52 to stop fluid flow through the casing segmentation device 32. For example, if the frac-ball 52 has a spherical geometry with a diameter "D", the ball seat 54 may have a truncated conical geometry with a forward opening having a diameter "$D_f$" and an aft opening with a diameter "$D_a$", wherein $D_f > D > D_a$ (see FIG. 5). In some embodiments, the mating frac-ball 52 may be configured with a non-symmetrical geometry and/or an external feature operable to orient the mating frac-ball 52 within the fluid flow.

In some embodiments, the present casing segmentation device 32 includes a fracture mechanism 35 having an amount of energetic material 62 and a trigger mechanism 68. The amount of energetic material 62 is adequate upon detonation to selectively fracture at least a portion or all of the casing segmentation device 32 into discrete pieces (e.g., in some embodiments only the ball seat 54 is fractured into discrete pieces, and in other embodiments substantially all of the casing segmentation device 32 is fractured into discrete pieces). The term "discrete pieces" is used herein to describe those pieces of the casing segmentation device 32 that are liberated from the original form of the casing segmentation device 32 (e.g., shown diagrammatically as pieces 54*a* liberated from the casing segmentation device 32), as opposed to granular sized material eroded or dissolved from the ball seat 54 that may go into solution within surrounding fluid.

The structural configuration and/or the material of the casing segmentation device 32 is chosen to be adequate to seat and retain the frac-ball during normal plug operations, and also to fracture into discrete pieces 54*a* upon the occurrence of an event (e.g., detonation of energetic material within the casing segmentation device 32, and/or detonation of a frac-ball 52). The present casing segmentation device 32 is not limited to any specific physical configuration, but rather can be any physical configuration capable of breaking into discrete pieces upon the detonation of an energetic material disposed within or on a casing segmentation device 32, or upon the detonation of an energetic material disposed within or on a frac-ball 52 seated within the casing segmentation, or the detonation of both. The specific amount and placement of the respective energetic material(s) can vary with the casing segmentation device 32 configuration to satisfy the application at hand. Non-limiting examples of casing segmentation device 32 material(s) include ceramic materials, rigid composites, bulk metallic glass, some grades of cast iron, or the like, or combinations thereof (other possible materials are described below). The ball seat 54 (and other portions of the casing segmentation device 32 in some embodiments) may be configured to include stress concentrations (e.g., machined or molded into the structure) to aid in the fracturing process.

In some embodiments, the casing segmentation device material that is intended to be liberated by the energetic material 62 (i.e., the discrete pieces) is configured to dissolve or erode in the well fluid environment. Once the portion of the casing segmentation device 32 (e.g., the ball seat 54) is fractured into the discrete pieces 54*a*, the aforesaid discrete pieces are disposed in the well fluid. The well fluid, in turn, reacts with the discrete pieces 54*a* causing them to at least partially dissolve or erode, thereby diminishing the size of each discrete piece, or pass into solution with the well fluid completely. Non-limiting examples of materials that will dissolve or erode when exposed to a well fluid environment (i.e., dissolve or erode in the presence of water, fracking fluids, fluids entering the casing from the environment surrounding the wellbore, etc.) that can be included within the ball seat material include bi-metallic materials such as the magnesium and aluminum nanocomposite formulations, degradable alloy materials such as galvanic corrosives, and dissolvable plastics such as machined polyglycolic acid. Preferably, the dissolvable/erodible material is such that the discrete pieces will dissolve/erode to an inconsequential size (from a fluid flow perspective) in less than thirty (30) days. Breaking the casing segmentation device 32 into discrete pieces greatly increases the surface area exposed to the well fluid and thus the rate of reaction between the discrete pieces and the surrounding well fluid and the consequent rate of dissolution/erosion.

Figure 5:
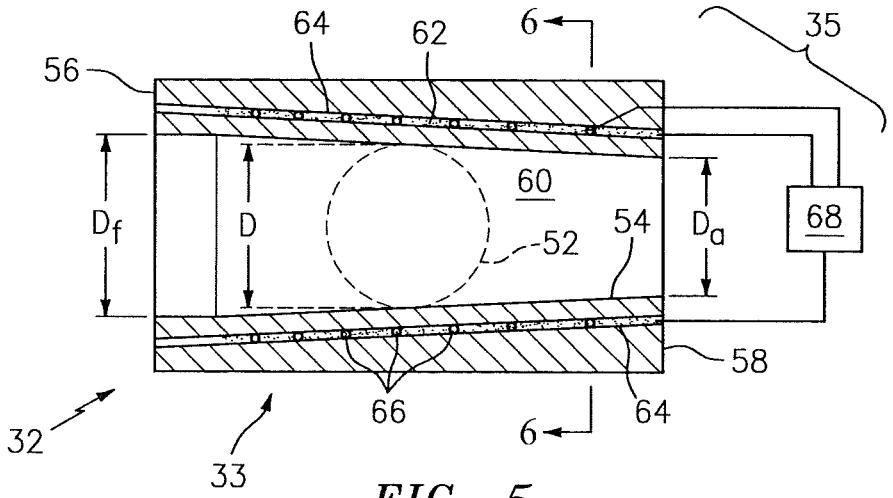
FIG. 5 is a diagrammatic cross-sectional view of a casing segmentation device according to the present disclosure.
Figure 6:
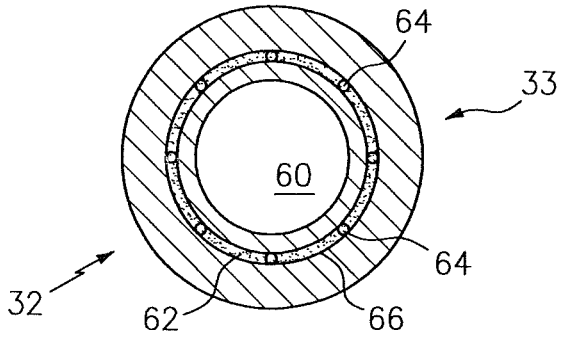
FIG. 6 is a diagrammatic cross-sectional view of the casing segmentation device shown in FIG. 5 as depicted by the section line 6-6.
Figure 7:
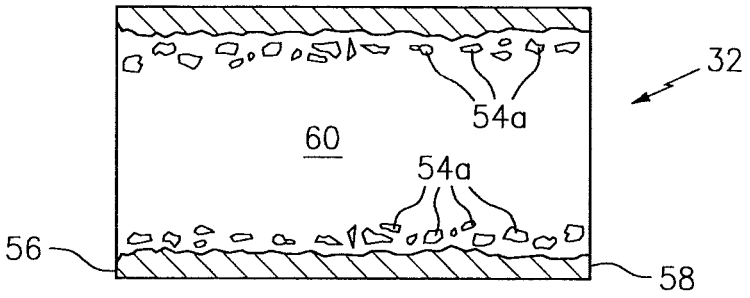
FIG. 7 is a diagrammatic cross-sectional view of a casing segmentation device, illustrating a destructed ball seat.
Figure 8:
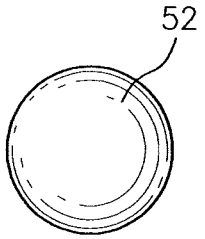
FIG. 8 is a diagrammatic illustration of a frac-ball embodiment.
Figure 9:
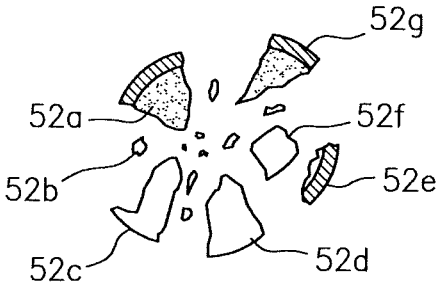
FIG. 9 is a diagrammatic illustration of a fractured frac-ball, shown in discrete pieces.
Figure 10:
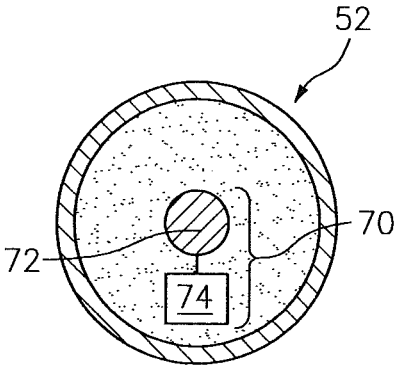
FIG. 10 is a sectional diagrammatic illustration of a frac-ball embodiment, including a fracture mechanism embodiment.

The casing segmentation device 32 may assume various different configurations to accommodate the amount of energetic material 62. For example, the casing segmentation device 32 may include one or more voids (e.g., pockets, channels, cavities, etc.) disposed within or on the casing segmentation device 32 in proximity to the ball seat 54 and/or within, or on, the ball seat 54 itself. The casing segmentation device 32 shown in FIGS. 5 and 6, for example, includes a plurality of channels disposed radially outside of the ball seat 54 and internally within the casing segmentation device 32. Specifically, the casing segmentation device 32 example shown in FIGS. 5 and 6 includes substantially axially extending channels 64 (i.e., on opposite sides of the internal fluid passage 60) and a plurality of circumferentially extending channels 66 intersecting the axial channels 64 (i.e., disposed radially outside of and extending around the circumference of the internal fluid passage 60). FIG. 6 is a cross-section taken at cut line 6-6 shown in FIG. 5 (FIG. 6 shows the entirety of the casing segmentation device, not just the section shown in FIG. 5). FIGS. 5 and 6 illustrate an amount of energetic material 62 disposed within the circumferentially extending channels 66 and within the axially extending channels 64 intersecting the circumferential channel 66. The energetic material 62 need not fill all of the aforesaid channels 64, 66, however. The present destructible casing segmentation device 32 is not limited to internal voids for holding an amount of energetic material 62, however; e.g., channels may be placed on external surfaces and/or internal surfaces of the casing segment device 32. Furthermore, the present casing segmentation device 32 is not limited to the exemplary internal channel configuration diagrammatically shown in FIGS. 5 and 6.

The number of the voids (e.g., pockets, channels, cavities, etc.) and/or the size of each void are chosen to facilitate breaking at least a portion of the casing segmentation device 32 into discrete pieces; e.g., the number and size of the voids may be chosen to accept an amount of energetic material 62 adequate to fracture at least a portion of the casing segmentation device 32 into discrete pieces. The configuration of some voids may also be chosen, not to accept energetic material, but rather to facilitate breaking the casing segmentation device 32 (or portions thereof) into the aforesaid discrete pieces. The positioning of the voids within, or on, the casing segmentation device 32 may be chosen based on the particular geometry of the ball seat 54 and the casing segmentation device 32. As indicated above, the present disclosure contemplates casing segmentation devices 32 configured to have less than all of the casing segmentation device 32 break into discrete pieces (e.g., just the ball seat 54), or all of the casing segmentation device 32 break into discrete pieces. In some applications it is preferable to have all or substantially all of the casing segmentation device break into pieces to minimize or eliminate any flow impediment within the casing 22.

The voids (e.g., pockets, channels, cavities, etc.) for receiving the energetic material can be machined or molded in place. A casing segmentation device 32 including internally disposed voids may be manufactured, for example, using additive manufacturing techniques (e.g., 3D printing). Additive manufacturing techniques are capable of tailoring the structural properties of the material (e.g., 3D printers may be used to produce metal and ceramic alloy objects), and are adept at producing objects with internal voids, which internal voids would otherwise be expensive and/or difficult to produce.

Examples of acceptable energetic materials 62 (e.g., explosive materials) that may be used in the present destructible casing segmentation device 32 include, but are not limited to, low coreload detonating cord, mild detonating fuse (MDF), injection loaded materials such as PBXN-301 or DEMEX 400, nylon jacketed ribbon cord, or discrete miniature detonators.

The present casing segmentation device 32 described above may be utilized as part of a sliding sleeve type casing segmentation device.

The trigger mechanism 68 (shown diagrammatically in FIG. 5) of the casing segmentation device fracture mechanism 35 is operable to detonate the energetic material 62 disposed within, or on, the casing segmentation device 32. The trigger mechanism 68 may assume a variety of different forms, and the present disclosure is not limited to any particular type of trigger mechanism. The trigger mechanism 68 may include one or more processors capable of processing instructions stored in a memory device (internal to the processor or in communication with the processor), one or more sensors (e.g., temperature sensors, pressure sensors, magnetic sensors, electromagnetic sensors, electrical conductivity sensors, etc.), timing devices, receivers (e.g., adapted to receive RF signals, ultrasonic signals, pressure pulse signals, etc.), etc. In those embodiments that include one or more sensors, timing devices, receivers, etc., such sensors, devices, or receivers may be in communication with the processor. The trigger mechanism 68 may be implemented in a variety of different forms (e.g., in a hardware form, or a combination of hardware and processor implemented stored instructions, etc.). Specific non-limiting examples of trigger mechanisms 68 that can be used with the present casing segmentation device 32 are described below.

A first example of a type of trigger mechanism 68 is one that is temperature related. Some wells have well portions where the subterranean environment is at an elevated temperature. In these applications, the fracturing fluid that is being pumped from the surface into the casing 22 may be no warmer than a known temperature (e.g., 80° F.) and during fracturing process the aforesaid fracturing fluid will maintain a casing segmentation device 32 at a temperature that is cooler than the surrounding well environment; e.g., the fracking fluid acts as a coolant. Once the fracturing operation at a stage is complete, the warmer temperature reservoir fluids and gases will raise the temperature of the casing segmentation device 32 via thermal conduction and/or convection. In this instance, the trigger mechanism 68 may be disabled below a predetermined temperature, and enabled at temperatures above the predetermined temperature. For example, an electronic component may be embedded within or attached to a casing segmentation device 32 that includes a temperature sensor. Once the temperature sensor detects a predetermined temperature (e.g., "a trigger temperature"), an electronic component (e.g., a processor receiving temperature data from the temperature sensor and configured to execute stored instructions) may directly or indirectly initiate the energetic material disposed within, or onto, the casing segmentation device 32.

In instances where the temperature within a well likely exceeds an electronic component operating temperature (e.g., above 120° C.), an alternative temperature related trigger mechanism 68 may be used. For example, a trigger mechanism that includes one or more bimetallic components may be used. The first bimetallic alloy component has a first melting temperature and a second bimetallic alloy component has a second melting temperature, which second melting temperature is higher than the first melting temperature. The first bimetallic alloy component and the second bimetallic alloy component are exothermically reactive with one another, and are initially separated from one another within the trigger mechanism 68. The first bimetallic alloy component is selected to have a melting temperature that coincides with the desired trigger temperature for fracturing a portion or all of the casing segmentation device 32. When the first bimetallic alloy component reaches the trigger temperature it melts, begins to flow, and contacts the second bimetallic alloy component, thereby triggering an exothermic reaction between the two bimetallic alloys. The exothermic reaction between the bimetallic alloy components generates sufficient thermal energy to ignite the energetic material. The ignition of the energetic material causes a portion or all of the casing segmentation device 32 to fracture into the discrete pieces. The present disclosure is not limited to the above described trigger mechanisms. Variations of the above described trigger mechanisms, or similar technologies can be used alternatively. U.S. Pat. No. 7,377,690, for example, discloses a non-electrical intermetallic type sensor that may be used. U.S. Pat. No. 5,466,537, which discloses another type of intermetallic sensor, is another example of a device that can be used within a trigger mechanism 68. Each of U.S. Pat. Nos. 7,377,690 and 5,466,537 is hereby incorporated by reference in its entirety. The specific trigger temperatures of any of these type devices can be modified to satisfy the application at hand.

A second type of trigger mechanism 68 is one that activates upon receipt or termination of a selectively emitted signal. For example, the trigger mechanism 68 may be selectively activated by radio frequency (RF) energy type signal, or an acoustic energy type signal (e.g., ultrasonic signal), a pressure pulse type signal traveling through the fracturing fluid, an electromagnetic inductive coupling (e.g., selective application or removal of a magnetic field), etc., or some combination thereof. Mud pulse telemetry ("MPT") is a non-limiting example of a communication technique that can be used. In a MPT system, a downhole located valve may be operated to restrict the flow of the drilling fluid in a manner acceptable to transmit digital information; e.g., opening and closing the valve to allow or restrict, respectively, the fluid flow within the drill pipe. The valve can be operated to produce interpretable pressure fluctuations. The pressure fluctuations propagate within the drilling fluid towards the surface where they are received from pressure sensors. The signals received by the pressure sensors are subsequently processed to produce the information. In a similar manner, information signals in the form of pressure fluctuations can be emitted into the fluid disposed within the casing 22 to send instructions to the trigger mechanism 68 of a casing segmentation device 32. The pressure fluctuation signals travel through the fluid and are sensed (e.g., by one or more pressure sensors) by the trigger mechanism 68. The sensed signals may then be provided to and interpreted by a processor portion of the trigger mechanism 68. The processor portion may then act upon stored instructions; e.g., act to cause the detonation of energetic material disposed within or on the casing segmentation device 32 and thereby break a portion or all of the casing segmentation device 32 into discrete pieces. For example, the processor portion may initiate an electrical circuit that generates an amount of energy sufficient to activate an exploding bridge-wire type detonator (e.g., a RP series detonator commercially available from Teledyne RISI). The energy released by the exploding bridge-wire detonator, in turn, provides sufficient energy to initiate energetic material disposed within or on the casing segmentation device 32. As another example, a "wired drill pipe system" may be used, wherein electrical wires are incorporated into the casing. Electrical signals may be conducted through the wires and received by the trigger mechanism 68 of the casing segmentation device 32. As a still further example, an electromagnetic trigger mechanism 68 may be used that includes an electrical insulator incorporated into the casing 22. For purposes of transmitting data, the trigger mechanism 68 may generate an altered voltage difference between a first part (e.g., the main casing 22, above the insulator), and a second part (e.g., a drill bit, or other tools located below the insulator). On the surface, a wire is attached to the wellhead, which makes contact with the casing 22 at the surface. A second wire is attached to a rod driven into the ground some distance away. The wellhead and the ground rod form the two electrodes of a dipole antenna. The voltage difference between the two electrodes is used as a signal that is received and processed by components of the trigger mechanism 68. The above examples of signal activated trigger mechanisms 68 are intended to be non-limiting, and as stated above a trigger mechanism 68 may be activated by other types of signals (e.g., RF signals, acoustic signals, electromagnetic signals, etc.).

A third type of trigger mechanism 68 is one that actuates based on timing; e.g., the trigger mechanism 68 can be programmed to detonate at a particular time, or after a predetermined interval of time. As an example, the trigger mechanism 68 may include counter/timer component that cooperates with a processor to cause the detonation of the energetic material. For example, a processor within the trigger mechanism 68 may be in communication with a memory device having stored instructions. Those instructions may include a pre-programmed period of time (for example initiated just prior to installation of the casing segmentation device). The counter/timer component indicates to the processor when the predetermined period of time has expired. The instructions then cause the processor to cause a detonating device (e.g., a bridge-wire detonator as described above) to initiate and cause the detonation of the energetic material, thereby causing some or all of the casing segmentation device to break into discrete pieces. In some embodiments, the counter/timer component may be utilized in combination with a signal from a sensor. For example, in some embodiments a trigger mechanism 68 may include a temperature sensor in communication with a processor. The temperature sensor provides temperature data to the processor. Upon receiving a signal from the temperature sensor that a particular predetermined temperature has been detected, the stored instructions may then cause the processor to start a time period with the counter/timer. The counter/timer, in turn provides an indication back to the processor when a predetermined period of time has expired. Upon expiration of the predetermined time period, the stored instructions then cause the processor to initiate a detonator device (e.g., a bridge-wire detonator as described above), which in turn detonates the energetic material disposed within the casing segmentation device 32, thereby causing a portion or all of the casing segmentation device 32 to break into discrete pieces. This example is provided as a non-limiting example, and the present disclosure is not limited thereto.

A fourth type of trigger mechanism 68 is one that is activated by pressure. For example, the trigger mechanism 68 may include or be in communication with one or more pressure sensors. The pressure sensors may be in communication with a processor portion of the trigger mechanism 68, which processor portion is in communication with a memory device having stored instructions. The pressure sensor(s) provide signals to the processor indicative of a relevant pressure (e.g., a fluid pressure in the casing 22 proximate the casing segmentation device 32). When the signals from the pressure sensor indicate the relevant pressure (e.g., a single pressure value, or an average pressure value over a period of time) is at or above a predetermined value, then the stored instructions cause the processor to cause a detonating device (e.g., a bridge-wire detonator as described above) to initiate and cause the detonation of the energetic material, causing some or all of the casing segmentation device to break into discrete pieces. The predetermined pressure value could be a high pressure resulting from a fracturing operation or it could be a hydrostatic pressure exerted by the column of fluid in the well. This example is provided as a non-limiting example, and the present disclosure is not limited thereto.

As indicated above and below, the casing segmentation device 32 described herein may be used with destructible frac-balls 52 and other types of frac-balls (e.g., frac-balls that dissolve or erode, frac-balls that may be fractured by mechanical intervention, etc.) As is described below, in those applications that utilize destructible frac-balls 52, the destructible frac-ball 52 itself may provide some or all of a trigger mechanism 68.

In some embodiments, the trigger mechanism 68 may be configured to include one or more safety features. For example, a trigger mechanism 68 may be configured to include an activating sequence that includes an inhibit whereby prior to initiation of the energetic material, the trigger mechanism 68 will query its surroundings to verify certain predetermined conditions. If the condition is satisfied, then the trigger mechanism will initiate fracture of a portion or all of the casing segmentation device 32.

A specific non-limiting example of how a trigger mechanism 68 for a casing segmentation device 32 may be configured is provided hereinafter to illustrate the utility of the present disclosure. In this example, a casing segmentation device 32 includes a trigger mechanism 68 having an electronic circuit (e.g., including one or more processors, a memory device containing stored instructions (e.g., programming), and one or more of the sensors described above) powered by a battery. The electronics are maintained in a dormant state until the casing segmentation device 32 is exposed to a predetermined pressure; e.g., typically a pressure that is above that normally encountered in a well environment. A pressure sensor portion of the trigger mechanism 68 provides signals to the processor portion of the trigger mechanism 68 indicative of the relevant pressure. When the pressure sensor indicates that a predetermined pressure exists, the stored instructions cause the processor to initiate a counter/timer. After a predetermined time period (e.g., 10 hours) has expired, the stored instructions may cause the processor to determine if a safety condition (e.g., a sensed temperature at or above a predetermined value) is been satisfied. If the safety condition is satisfied, then the stored instructions cause the processor to initiate a detonator that in turn detonates energetic material disposed within the casing segmentation device 32, causing some or all of the casing segmentation device 32 to break into the discrete pieces. If the trigger mechanism 68 determines the safety condition is not met, then the electrical energy may be bled from the circuit, thereby disarming the trigger mechanism 68 and rendering it safe. As indicated above, this example is provided to illustrate an example of a trigger mechanism 68 for a casing segmentation device 32; e.g., one that is operable to evaluate one or more safety conditions. The present disclosure is not limited to this example.

Now referring to FIGS. 8-15, as indicated above the present destructible casing segmentation device 32 may be used in conjunction with a destructible frac-ball 52. The destruction of a frac-ball 52 and mating casing segmentation device 32 can be coordinated in several ways; e.g., the destruction of a frac-ball 52 seated within the ball seat of a casing segmentation device 32 causes the destruction of the ball seat 54, via coordinated timers, via a casing segmentation device trigger mechanism 68 that senses the frac-ball 52 destruction, via a trigger mechanism 68 that receives a signal from the frac-ball 52, or from the surface, etc.

An example of a destructible frac-ball 52 that may be used with the present casing segmentation device 32 is described in U.S. patent application Ser. No. 14/935,114 filed on Nov. 6, 2015, which application is hereby incorporated by reference in its entirety. The present casing segmentation device 32 can be used, however, without a destructible frac-ball 52; e.g., the present casing segmentation device 32 may be used with a dissolvable or an erodible frac-ball.

For those embodiments that do utilize a destructible frac-ball 52, the destructible frac-ball 52 is adapted to be selectively fractured into a plurality of discrete pieces (e.g., depicted in FIG. 9 as pieces 52*a*, 52*b*, 52*c*, 52*d*, 52*e*, 52*f*, 52*g*, etc.), with each discrete piece smaller in volume than the frac-ball 52 from which it came. At the time of fracture, or some time thereafter, each discrete frac-ball piece is of a size inadequate to prevent fluid flow through the internal passage 60 of the casing segmentation device 32. The term "discrete pieces" is used herein to describe those frac-ball 52 pieces liberated from the original form of the frac-ball 52 as a result of the frac-ball 52 being fractured, as opposed to granular sized material eroded or dissolved from the frac-ball 52 that may go into solution within surrounding fluid. A frac-ball 52 according to the present disclosure is not limited to any particular geometry, other than having a geometry that mates with a ball seat 54 to stop fluid flow through the casing segmentation device 32. A spherical geometry is a non-limiting example of a useful frac-ball 52 geometry. In those applications wherein a plurality of destructible frac-balls 52 are used, some or all of the plurality of frac-balls 52 may have the same geometry (e.g., same diameter spherical shape). In other applications, the plurality of frac-balls 52 may have graduated sizes; e.g., "n" number of spherical frac-balls 52, progressively smaller/larger in diameter that may be used in a sliding sleeve type casing segmentation device 32.

In some embodiments, the destructible frac-ball 52 may include a fracture mechanism 70 (e.g., diagrammatically shown in FIG. 10) that is operable to selectively break the frac-ball 52 into the plurality of discrete pieces described above. An example of a fracture mechanism 70 is one that includes an energetic material 72 (e.g., an explosive) and a frac-ball trigger mechanism 74. Another example of a fracture mechanism 70 is a mechanical device, etc., coupled with a frac-ball trigger mechanism. The present disclosure therefore is not limited to any particular type of fracture method or devices for fracturing the frac-ball 52.

The trigger mechanism 74 of a frac-ball 52 may assume a variety of different forms, and the present disclosure is not limited to any particular type of trigger mechanism. The trigger mechanisms 68 described above for use with the casing segmentation device are illustrative of the types of trigger mechanisms 74 that may be used with frac-balls 52. An additional type of trigger mechanism 74 that may be used with a frac-ball 52 is one where the frac-ball 52 is physically processed prior to deployment. For example, the trigger mechanism 74 can be configured to activate upon the frac-ball 52 being spun at a predetermined rotational speed (e.g., "X" rotations per minute—"RPMs") to arm the device prior to deployment.

In some embodiments, a frac-ball 52 may be configured to include one or more safety features. For example, a frac-ball 52 may be configured to include an activating sequence that includes an inhibit whereby prior to fracture initiation, the frac-ball trigger mechanism 74 will query its surroundings to verify certain predetermined conditions. If the condition is satisfied, then the trigger mechanism 74 will initiate rupture of the frac-ball 52. Non-limiting examples of safety features include the trigger mechanism 74 sensing to determine if the frac-ball 52 is surrounded by ferrous material (e.g., the well pipe) or a fracturing fluid (e.g., via conductivity), or other safety features such as those described above for use with a casing segmentation device 32. If the safety condition is not met, the trigger mechanism 74 will not initiate rupture of the frac-ball 52.

In those embodiments wherein the frac-ball fracture mechanism 70 includes an energetic material 72, the energetic material may be constructed from or otherwise include an amount of energetic material such as, but not limited to, lead azide, zirconium potassium perchlorate (ZPP), gasless ignition powders such as A1A (e.g., comprising Zirconium powder, Ferric oxide, and diatomaceous earth), pentaerythritol tetranitrate (PETN), cyclotrimethylenetrinitramine (RDX), and diazodinitrophenol (DDNP). The energetic material 72 may be adapted to energize (e.g., activate and explode) upon receiving or otherwise being subjected to a command signal such as, but not limited to, a radio wave trigger. Alternatively, the energetic material 72 may also include a detonator adapted to energize the energetic material upon receiving a command signal. In this manner, a controller or human operator may selectively activate the energetic material and thereby selectively cause the frac-ball 52 to fracture.

Some embodiments of the present casing segmentation device 32 may be configured to cause the destructible frac-ball 52 to rupture into the aforesaid discrete pieces. For example, a casing segmentation device 32 may include a mechanical feature (e.g., a pin, blade, etc.) that is actuated to strike the frac-ball 52 and thereby cause the frac-ball 52 to rupture into the aforesaid discrete pieces. In these embodiments, the frac-ball 52 may not include an energetic device; i.e., upon detonation of the casing segmentation device 32, the mechanical feature of the casing segmentation device 32 is adequate to fracture the frac-ball 52 into discrete pieces.

As indicated above, in some embodiments a destructible frac-ball 52 itself may provide some or all of a casing segmentation device trigger mechanism 68. For example, the detonation of energetic material within a frac-ball 52 (by any of the means described above) may provide sufficient energy to cause a portion or all of the casing segmentation device 32 to break into discrete pieces. In these embodiments (as stated above), the casing segmentation device 32 may be mechanically configured so that energy received by the detonating frac-ball 52 is sufficient to break the casing segmentation device 32 into discrete pieces without the need for detonation of energetic material within the casing segmentation device 32. For example, the casing segmentation device 32 may be mechanically configured to withstand the forces and pressures typically encountered during implementation and operation of the device 32 as a fluid plug, but upon receipt of energy/mechanical force from the detonating frac-ball 52, a portion or all of the casing segmentation device 32 breaks into discrete pieces. In other embodiments, the detonation of energetic material within a frac-ball 52 (by any of the means described above) may provide the impetus to initiate energetic material disposed within the casing segmentation device 32 (e.g., the detonating frac-ball 52 may act as a part of the trigger mechanism 68 for the casing segmentation device 32). For example as described above, a trigger mechanism 68 for a casing segmentation device 32 may include a sensor (e.g., a pressure or temperature sensor). The initiation of energetic material within the frac-ball 52 can produce a change in the environment proximate the casing segmentation device 32 (e.g., provide an elevated temperature or pressure), which change is sensed by the sensor. The sensor, in turn, provides a signal to the processor portion of the casing segmentation device trigger mechanism 68, and the trigger mechanism 68 causes the casing segmentation device 32 to break into discrete pieces (as described above). The present disclosure is not limited to these examples; e.g., the casing segmentation device trigger mechanism 68 may be initiated shock waves, acoustic waves, etc. produced by the detonating frac-ball 52, or from another source.

In regards to the method aspect of the present disclosure, as described above prior to segmentation of a well casing 22 a casing segmentation device 32 is positioned within the well casing 22 at a defined position to enable the creation of a well casing segment. During segmentation, a frac-ball 52 is introduced into the well casing 22 and is received within the ball seat 54. The mating configuration of the frac-ball 52 and the ball seat 54 prevents appreciable fluid flow through the casing segmentation device 32; i.e., the casing segmentation device is "plugged". The fluid on one side of the casing segmentation device 32 may then be increased dramatically in pressure; e.g., to perform the perforation/fracturing process. Once the fracturing process is completed, it is necessary to "unplug" the casing segmentation device 32 to permit fluid travel within the well casing 22. The casing segmentation device 32 can be "unplugged" by removing the frac-ball 52 from the mating ball seat 54; e.g., removing either the frac-ball 52 (e.g., by destroying it) or removing the ball seat 54 (e.g., by destroying it) will "unplug" the casing segmentation device. In some instances, however, it may be preferable to remove the frac-ball 52 as well as a portion (e.g., the ball seat 54 portion) or substantially all of the casing segmentation device 32. Depending on the configuration of the casing segmentation device 32, if only the frac-ball 52 is removed, the remaining casing segmentation device 32 may present a flow impediment to fluid flow there through.

According to aspects of the present method for selectively providing a fluid flow passage through a casing segmentation device, a frac-ball 52, a casing segmentation device 32, and a first fracture mechanism are provided. The first fracture mechanism may be provided with either the frac-ball 52 or the casing segmentation device 32. In a first embodiment, the first fracture mechanism is provided with the casing segmentation device 32. The first fracture mechanism includes an amount of energetic material that produces sufficient energy when detonated to break the at least a portion of the casing segmentation device body into discrete pieces. Hence, a fluid flow passage through a "plugged" casing segmentation device may be created by breaking at least a portion of the casing segmentation device 32 into pieces. The casing segmentation device 32 may also be configured, upon detonation, to cause the seated frac-ball 52 to break into discrete pieces; e.g., a mechanical element striking the frac-ball 52 causes the frac-ball 52 to break into the discrete pieces without any detonation of the frac-ball 52.

In another embodiment, the first fracture mechanism is provided with the frac-ball 52. The first fracture mechanism includes an amount of energetic material that produces sufficient energy when detonated to break the frac-ball 52 into discrete pieces, and at least a portion of the casing segmentation device 32 to break into discrete pieces; e.g., at least a portion of the casing segmentation device 32 is physically configured to break into discrete pieces upon the detonation of the frac-ball 52. Hence, a fluid flow passage through a "plugged" casing segmentation device may be created by breaking the frac-ball 52 and at least a portion of the casing segmentation device 32 into pieces.

In another embodiment, one of the casing segmentation device 32 or the frac-ball 52 includes the first fracture mechanism, and the other of the casing segmentation device 32 and the frac-ball 52 includes a second fracture mechanism; e.g., the first fracture mechanism is provided with the frac-ball 52 and the second fracture mechanism is provided with the casing segmentation device 32. Communications with the frac-ball 52 and/or the casing segmentation device 32 can be used to selectively detonate the energetic material contained within the respective fracture mechanism. The aforesaid detonations can be accomplished independent of one another, or they can be accomplished in a related manner. For example as described above, the detonation of the energetic material within a seated frac-ball 52 can cause detonation of energetic material within the casing segmentation device 32, or provide at least a part of the trigger mechanism (or a signal received by the trigger mechanism) used to cause detonation of energetic material within the casing segmentation device 32, or vice versa.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined with any one of the aspects and remain within the scope of the invention. Accordingly, the present invention is not to be restricted except in light of the attached claims and their equivalents.

What is claimed is:

1. A casing segmentation device, comprising:

a body having a forward end, an aft end, a plug seat, and an internal passage, wherein the plug seat is configured to receive a mating plug, and which plug seat is disposed between the forward end and the aft end, and wherein the internal passage extends between the forward end and the aft end and through the plug seat; and a fracture mechanism including an amount of energetic material and a trigger mechanism, which trigger mechanism is configured to selectively cause a detonation of the amount of energetic material;

wherein the body includes at least one void and the energetic material is disposed within the at least one void.

2. The device of claim 1, wherein the trigger mechanism includes at least one sensor configured to sense an environmental parameter to which the casing segmentation device is exposed, and to produce a sensor output.

3. The device of claim 2, wherein the trigger mechanism includes at least one processor in communication with a memory device and the at least one sensor, wherein the memory device stores instructions that, when executed by the processor, utilize the sensor output when selectively causing a detonation of the amount of energetic material.

4. The device of claim 1, wherein the at least one void includes a plurality of voids disposed in proximity to the plug seat, and the amount of energetic material is sufficient upon said detonation to fracture the plug seat.

5. The device of claim 1, wherein the amount of energetic material produces sufficient energy when detonated to break at least a portion of the body into discrete pieces.

6. The device of claim 1, wherein the body consists of a material that dissolves or erodes in the presence of a well fluid.

7. A well casing segmentation system, comprising:

a frac-ball having an initial configuration; and a casing segmentation device having a body with a forward end, an aft end, a ball seat, and an internal passage, and which ball seat is disposed between the forward end and the aft end, and wherein the internal passage extends between the forward end and the aft end and through the ball seat, wherein the ball seat is configured to receive the frac-ball and to prevent the initial configuration frac-ball from passing through the ball seat; and a first fracture mechanism that includes a first amount of energetic material and a first trigger mechanism configured to selectively cause a detonation of the first amount of energetic material, which first fracture mechanism is provided with the casing segmentation device.

8. The system of claim 7, wherein the first amount of energetic material produces sufficient energy when detonated to break at least a portion of the body into discrete pieces.

9. The system of claim 8, wherein the first trigger mechanism includes at least one processor in communication with a memory device, which first trigger mechanism memory device stores instructions that when executed by the at least one first trigger mechanism processor selectively causes the detonation of the first amount of energetic material.

10. The system of claim 9, wherein the body comprises one or more materials that dissolve or erode when exposed to a well fluid.

11. The system of claim 8, wherein the frac-ball includes a second fracture mechanism having a second amount of energetic material and a second trigger mechanism having at least one processor in communication with a memory device, which second trigger mechanism memory device stores instructions that when executed by the second trigger mechanism processor selectively causes the detonation of the second amount of energetic material.

12. The system of claim 11, wherein the second amount of energetic material produces sufficient energy when detonated to break the frac-ball into discrete pieces.

13. A well casing segmentation system, comprising:

a frac-ball having an initial configuration; and a casing segmentation device having a body with a forward end, an aft end, a ball seat, and an internal passage, and which ball seat is disposed between the forward end and the aft end, and wherein the internal passage extends between the forward end and the aft end and through the ball seat, wherein the ball seat is configured to receive the frac-ball and to prevent the initial configuration frac-ball from passing through the ball seat; and a first fracture mechanism that includes a first amount of energetic material and a first trigger mechanism configured to selectively cause a detonation of the first amount of energetic material, which first fracture mechanism is provided with the frac-ball; and the casing segmentation device is configured to break into discrete pieces upon detonation of the first amount of energetic material; and the frac-ball is configured to break into discrete pieces upon detonation of the first amount of energetic material.

14. The system of claim 13, wherein the casing segmentation device includes a second fracture mechanism having a second amount of energetic material, wherein the detonation of the first amount of energetic material causes the detonation of the second amount of energetic material.

15. A method for selectively providing a fluid flow passage through a casing segmentation device disposed within a well casing segment, comprising:

providing a frac-ball having an initial configuration;

providing a casing segmentation device having a body with a forward end, an aft end, a ball seat, and an internal passage, and which ball seat is disposed between the forward end and the aft end, and wherein the internal passage extends between the forward end and the aft end and through the ball seat, wherein the ball seat is configured to receive the frac-ball and to prevent the initial configuration frac-ball from passing through the ball seat and thereby prevent fluid flow through the casing segmentation device;

providing a first fracture mechanism that includes a first amount of energetic material and a first trigger mechanism configured to selectively initiate the first amount of energetic material with the casing segmentation device; and communicating with the first trigger mechanism to selectively detonate the first amount of energetic material, wherein the detonation of the first amount of energetic material causes the casing segmentation device to break into discrete pieces, thereby providing the fluid flow passage through the casing segmentation device.

16. The method of claim 15, wherein the first amount of energetic material produces sufficient energy when detonated to break the frac-ball into discrete pieces.

* * * * *